United States Patent [19]

Florin

[11] Patent Number: 4,809,610

[45] Date of Patent: Mar. 7, 1989

[54] DELAY DETONATOR

[75] Inventor: Hans Florin, Troisdorf Sieglar, Fed. Rep. of Germany

[73] Assignee: Dynamit Nobel Aktiengesellschaft, Troisdorf, Fed. Rep. of Germany

[21] Appl. No.: 921,203

[22] Filed: Oct. 21, 1986

[30] Foreign Application Priority Data

Apr. 26, 1986 [DE] Fed. Rep. of Germany ..... 3614204

[51] Int. Cl.[4] ..... F42B 3/16

[52] U.S. Cl. ..... 102/205; 102/275.2; 102/275.12

[58] Field of Search ..... 102/322, 200, 204, 205, 102/275.2, 275.3, 275.7, 275.9, 275.11, 275.12

[56] References Cited

U.S. PATENT DOCUMENTS

| | | | |
|---|---|---|---|
| 704,465 | 7/1902 | Kirsanov | 102/322 |
| 3,368,485 | 2/1968 | Klotz | 102/275.2 |
| 4,664,033 | 5/1987 | Burkdoll et al. | 102/275.2 |

FOREIGN PATENT DOCUMENTS

| | | | |
|---|---|---|---|
| 0749682 | 1/1967 | Canada | 102/200 |
| 2452080 | 5/1976 | Fed. Rep. of Germany | 102/200 |
| 3123250 | 1/1983 | Fed. Rep. of Germany | 102/275.12 |
| 197309 | 4/1923 | United Kingdom | 102/275.12 |

*Primary Examiner*—Charles T. Jordan
*Assistant Examiner*—Michael J. Carone
*Attorney, Agent, or Firm*—Antonelli, Terry & Wands

[57] ABSTRACT

A nonelectric delay detonator has means for allowing an ignition flame to be transmitted from an ignition transfer hose to a delay device. The delay device causes a secondary charge to detonate after a predetermined delay time. In order to obtain reproducibile delay times of the delay device, a check valve is arranged between one end of the ignition transfer hose and the delay device; this check valve being opened for a short time period due to the excess pressure in the hose and permitting the ignition flame to pass through. During deflagration of the delay device, the check valve is closed again so that the delay device burns within a closed system. In this manner, undefined pressure and gas losses are avoided.

7 Claims, 3 Drawing Sheets

DELAY DETONATOR

This invention relates to a delay detonator, especially a nonelectric delay detonator, having a casing containing a secondary charge and a delay means for establishing a delay time period for the detonator, an ignition transfer hose extending into one end of the casing and valve means for controlling activation of the delay means.

Delay detonators serve for causing explosion of various charges in a specific sequence in rock blasting or in mining operations. Each delay detonator contains a delay means for delaying ignition of the charge by an exactly defined delay period. Electrical delay detonators are initiated by the electric ignition of a fusehead. An electrical delay detonator constitutes a "closed system" wherein all pyrotechnical components are surrounded by a metallic sleeve.

Nonelectric delay detonators are furthermore known which are connected to an ignition transfer hose. Threads of a reactive material (e.g. nitrocellulose) extend within the hose. By igniting these threads at one end of the hose, a self-sustaining ignition flame is produced in the hose together with a shock wave whereby flammable materials can be ignited at the other end of the hose. The hose transmits the ignition flame to the delay detonator and effects first of all the deflagration of a pyrotechnical delay charge of the delay means which charge determines the individual delay time of the delay detonator. Since the hose projects into the casing of the delay detonator, the delay detonator constitutes an "open system". Such an open system has the drawback that the pressure being built up in the casing can be released, in part in an undefinable fashion, through the hose so that the desired defined delay period cannot be attained. Therefore, delay detonators according to the open system exhibit considerable scattering widths or variations of the delay times.

The invention is based on the object of providing a nonelectric delay detonator which achieves a defined ignition delay with a small scattering width and in this respect is equivalent to the scattering width achieved by electric delay detonators.

This object has been obtained according to this invention by providing a valve means for controlling entry of the ignition flame and shock wave into the delay detonator.

According to the invention, a check valve is arranged between the interior of the ignition transfer hose and the delay means, this check valve opens only in the case where the pressure in the hose is higher than the pressure in the casing. Once the ignition flame has penetrated into the casing so that ignition has progressed into the casing (i.e. the ignition of components within the casing is initiated), then an excess pressure is created by gas formation within the casing, causing the check valve to close. From this point in time on, the delay detonator operates with a "closed system", i.e. a defined pressure buildup results and a defined propagation of ignition takes place through the delay means without the possibility of pressure escaping into the hose. The advantage of the nonelectric delay detonator according to this invention resides in obtaining very small scattering widths of the delay times or period of delay. The resultant uniformity with which the delay detonators of each time stage ignite is of decisive importance for a satisfactory blasting result. The delay charge deflagrates in a closed space, it being impossible for any pressure and gas release to take place by way of the hollow, open hose. Thereby a defined delay time is accurately maintained. It is possible by means of this invention to attain, with nonelectric delay detonators, similarly small delay scattering ranges as otherwise obtainable only with electric delay detonators having a closed system. The invention provides means for sealing the section of the delay detonator which contains the delay means, with the aid of the check valve, from the hollow space of the hose as soon as the ignition flame has been transmitted into the casing. The check valve opens only in the brief period of the ignition initiating phase (a few milliseconds) and then closes again so that the delay means deflagrates under the defined and uniform conditions of a sealed volume.

Advantageous embodiments and further features of the invention will be understood from the following description and appended claims.

Various embodiments of the invention are described in greater detail below with reference to the accompanying drawings wherein:

FIG. 1 shows a longitudinal section through a first embodiment of the delay detonator;

FIGS. 2*a* through 2*c* show, respectively, a longitudinal sectional view of the check valve of the delay detonator according to FIG. 1, an end view of the valve in the closed condition and another end view of the valve in the opened condition of the valve;

FIGS. 3*a* through 3*c* show, respectively, in a similar representation to FIGS. 2*a*–2*c*, another embodiment of the check valve;

Figure 1:
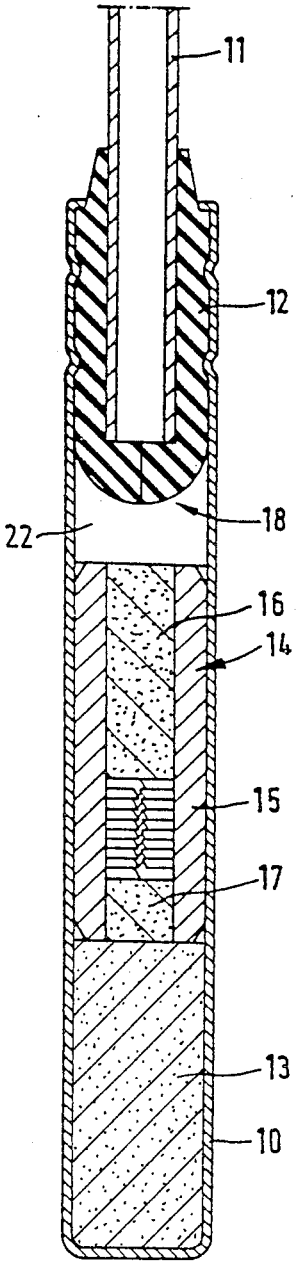

The delay detonator illustrated in FIGS. 1 and 2*a*–2*c* comprises a cylindrical casing 10 of metal (e.g. aluminum or copper) or similar material and closed at the lower end, a hose 11 extending into its other end. The hose 11 made out of plastic (e.g. polyethylene) is an ignition transfer hose (for example "Signal-Tube", manufactured by ATLAS Powder Company). containing reactive material (e.g. nitrocellulose). One end portion of the hose 11 is surrounded in the interior of the casing 10 by a sealing plug 12 made out of plastic (e.g. soft PVC modified with NBR), attached by crimping to the hose and effecting a seal between hose and casing.

The lower portion of the casing 10 contains the secondary charge 13 (secondary explosive). A delay device or means 14 is located above the secondary charge (e.g. Tetryl or PETN). This delay means comprises a tube 15 (e.g. die-cast zinc), the tube containing in its upper part a delay charge 16 for determining the delay time and in its lower part an initiating charge 17 (initiating explosive e.g. lead oxide) for igniting the secondary charge 13.

Figure 2A:
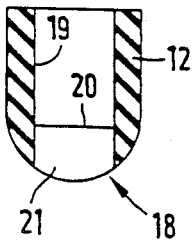
Figure 2B:
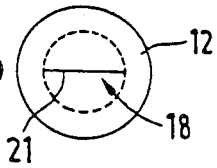
Figure 2C:
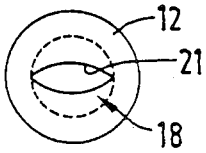

The sealing plug 12, consisting of an elastomeric material (e.g. soft PVC modified with NBR), surrounds the end of the hose 11 in the interior of the casing 10. The frontal end of the sealing plug 12 forms a check valve 18 in the shape of the slit-type valve illustrated in detail in FIG. 2. The end wall of the sealing plug 12 is of a hemispherical configuration, i.e. it is curved toward the interior of the casing. A duct 19 for accommodation of the hose 11 terminates as shown in FIG. 2*a* at the bottom wall 20 on the end face. From the bottom wall 20, a slit 21 extends axially through the end wall of he sealing plug 12. FIG. 2*b* shows an end view of the sealing plug with the slit 21 being closed. On account of the elasticity of the sealing plug, the slit 21 is maintained in the closed condition as long as there occurs no excess pressure in the interior of the sealing plug or, respectively, of the hose 11. In case of excess pressure in the sealing plug 12, the slit edges are spread apart as shown in FIG. 2*c* so that the slit 21 is opened.

The delay detonator of FIGS. 1 and 2 has the following mode of operation:

The reaction progressing within the hose 11 causes a rise in gas pressure, by means of which the check valve 18 is opened so that the ignition flame passes from the hose 11 through the opened slit 21 and the empty interspace 22 to the ignition surface of the delay charge 16. Thereby, the delay charge 16 is ignited. After a predetermined delay time, the length of which is defined by the delay means 14, the secondary charge 13 is caused to detonate.

Since the hose 11 through its cavity is open toward the outside, the pressure rise effected in the hose by the reaction is only of short duration. The excess pressure in the hose drops again to normal pressure after about 5 ms, so that the slit 21 closes again after elapse of this time period. Excess gas pressure remains in the interspace 22. Owing to the hemispherical shape of the frontal end of the sealing plug 12 and due to the excess pressure in the interspace 22, the check valve 18 is maintained in a closed condition so that the delay charge 16 deflagrates in a sealed space.

Figure 3A:
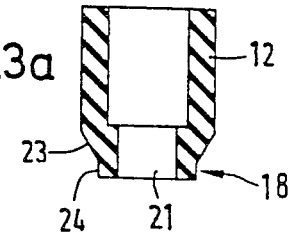
Figure 3B:
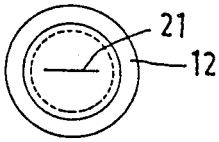
Figure 3C:
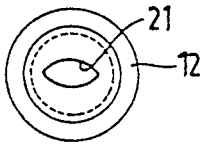

FIGS. 3*a*–3*c* shows another embodiment of the sealing plug 12 constituting the check valve 18. The end wall of the sealing plug in this embodiment consists of a zone 23 having the shape of a truncated cone, adjoining the sidewall, and of a subsequent cylindrical zone 24. A slit 21 extends through zones 23 and 24. Also in this arrangement, the slit 21 is normally maintained in the closed condition due to the elasticity of the plug material; only upon the occurrence of excess pressure in the interior of the sealing plug 12 will the slit 21 open up according to FIG. 3*c*.

Figure 4:
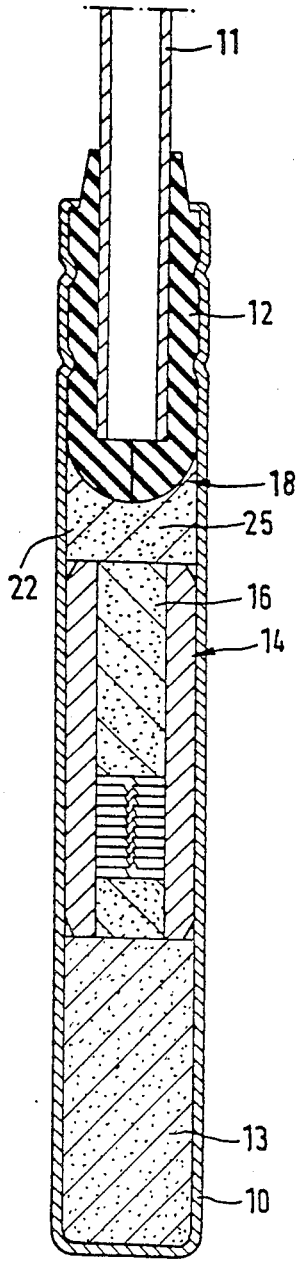
FIG. 4 shows a delay detonator with an additional pyrotechnical material for sealing the check valve by welding after the valve has been reclosed.

The embodiment of FIG. 4 corresponds to that of FIGS. 1 and 2, except for the fact that a pyrotechnical, reactive material 25 is arranged in loose packing in the interspace 22 between the frontal end of the sealing plug 12 and the delay means 14. This material 25 serves the purpose of transmitting ignition from the opened slit of the check valve 18 to the delay charge 16. Preferably, a mixture producing a large amount of heat, but a small amount of gas is utilized as the pyrotechnical material, so that the evolving heat causes the surface of the check valve 18 to melt, and the valve slit is sealed even more effectively by being melted shut.

Figure 5:
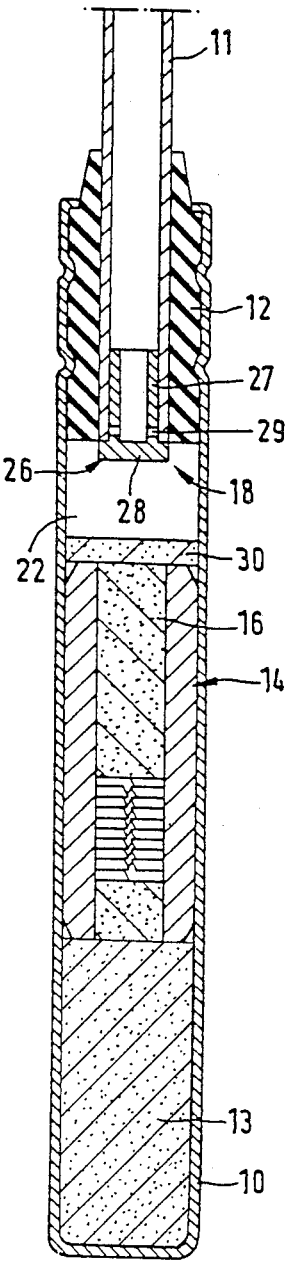
FIG. 5 shows a third embodiment of the delay detonator with a check valve exhibiting a displaceable valve body, with the valve being closed.
Figure 6:
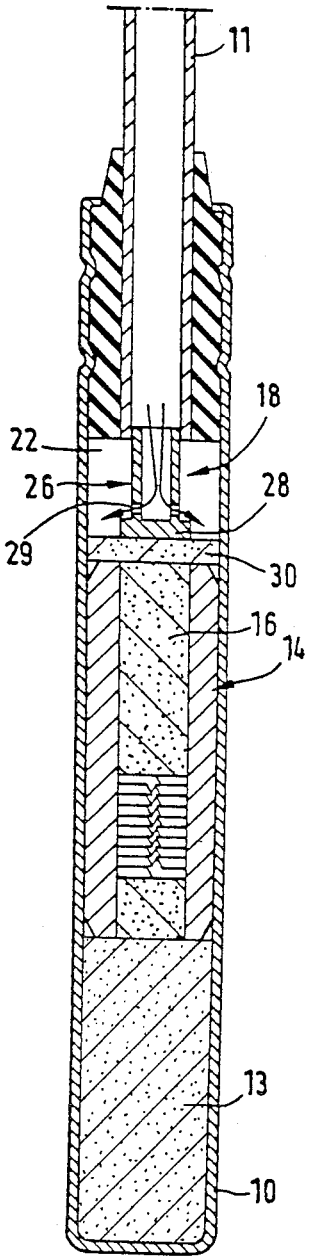
FIG. 6 shows the delay detonator according to FIG. 5 with the valve in the open condition.

Also the embodiment of FIGS. 5 and 6 corresponds basically to the first embodiment, so that the following description is made with reference to the differences. The check valve 18 has, according to FIGS. 5 and 6, an essentially rigid valve body 26 (e.g. hard PVC) projecting with a tubular member 27 into the end of the hose 11 and resting with its end wall 28 on the end of the hose 11, open at the end face. The sealing plug 12 terminates flush with the hose 11 in the interior of the casing 10. radial exhaust openings 29 are provided in the tubular member 27 in the proximity of the end wall 28.

In the sealed condition, the holes 29 are located in the interior of the hose 11, and are sealed by the side wall of the hose. For the purpose of opening the check valve 18, the valve body 26 moves axially into the interspace 22, the rearward end still being guided within the hose 11, while the end wall 28 abuts against the transmission charge or booster 30 which is in contact with the delay unit 14 (FIG. 6). The booster charge 30 is ignited, with the check valve being open, through the openings 29 from the interior of the hose 11. The booster charge 30 is designed so that it ignites, on the one hand, the delay charge 16 and, on the other hand, produces suddenly such a large quantity of gas that thereby the check valve 18 is reclosed by pushing the valve body 26 back into the hose 11.

Figure 7:
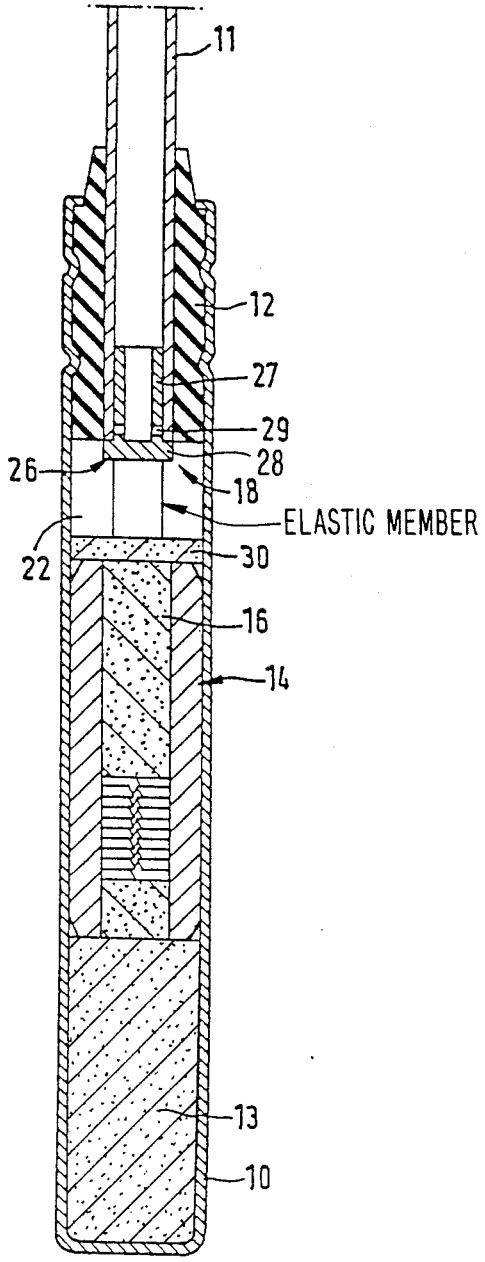
FIG. 7 shows an embodiment of the delay detonator with a check valve having a displaceable valve body that is elastically pretensioned.

It is furthermore possible to provide an elastic device, e.g., an elastic member, for pretensioning the valve body 26 in the direction toward its closed condition as shown in FIG. 7.

What is claimed is:

1. A delay detonator comprising a casing, in sequence, a secondary charge and a deflagratable delay means for defining the delay time period of the detonator, an ignition transfer hose extending into one end of said casing through a sealing plug, said hose containing reactive means for producing an ignition flame that exits from one end of the ignition transfer hose and causes the secondary charge to detonate after a predetermined delay time; and a check valve arranged between the interior of the one end of the hose and the delay means that can be passed through by said ignition flame only in one direction from the end of the hose to the delay means; said check valve being opened only for a short period of time to allow passage of said ignition flame and then being closed again so that the delay means will deflagrate in a closed volume.

2. A delay detonator comprising a casing, in sequence, a secondary charge and a deflagratable delay means for defining the delay time period of the detonator, an ignition transfer hose extending into one end of said casing through a sealing plug, said hose containing reactive means for producing an ignition flame that exits from one end of the ignition transfer hose and causes the secondary charge to detonate after a predetermined delay time; and a check valve arranged between the interior of the one end of the hose and the delay means that can be passed through by said ignition flame only in one direction from the end of the hose to the delay means; said check valve having a closed opening which is opened only for a short period of time to allow passage of said ignition flame and means for closing said opening after said passage so that the delay means will deflagrate in a closed volume.

3. A delay detonator according to claim 2, wherein the check valve comprises an elastic slit-type valve integrally formed with the sealing plug; said check valve extending over an open portion of the one end of the hose and being located in the interior of the casing.

4. A delay detonator according to claim 2, wherein the check valve exhibits a valve body displaceable in the longitudinal direction of one end of the hose and the valve body is elastically pretensioned for sealing the hose.

5. A delay detonator comprising a casing containing, in sequence, a secondary charge and a delay means for defining the delay time period of the detonator, an ignition transfer hose extending into one end of said casing through a sealing plug, said hose containing reactive means for producing an ignition flame that exits from one end of the ignition transfer hose and that is to be transmitted to the delay means which, in turn, causes the secondary charge to detonate after a predetermined delay time; and a check valve arranged between the interior of the one end of the hose and the delay means that can be passed through by said ignition flame only in one direction from the end of the hose to the delay means; the check valve comprising an elastic slit-type valve integrally formed with the sealing plug and said check valve extending over an open portion of the one end of the hose and being located in the interior of the casing; a pyrotechnical charge being arranged between the slit-type valve and the delay means, said material being acted upon by the ignition flame and, during deflagration, welding shut the slit-type valve in the closed condition.

6. A delay detonator comprising a casing containing, in sequence, a secondary charge and a delay means for defining the delay time period of the detonator, an ignition transfer hose extending into one end of said casing through a sealing plug, said hose containing reactive means for producing an ignition flame that exits from one end of the ignition transfer hose and that is to be transmitted to the delay means which, in turn, causes the secondary charge to detonate after a predetermined delay time; and a check valve arranged between the interior of the one end of the hose and the delay means that can be passed through by said ignition flame only in one direction from the end of the hose to the delay means; said check valve exhibiting a valve body displaceable in a longitudinal direction of one end of the hose and an ignition propagation charge being arranged between the check valve and the delay means.

7. A delay detonator comprising a casing containing, in sequence, a secondary charge and a delay means for defining the delay time period of the detonator, an ignition transfer hose extending into one end of said casing through a sealing plug, said hose containing reactive means for producing an ignition flame that exits from one end of the ignition transfer hose and that is to be transmitted to the delay means, which in turn, causes the secondary charge to detonate after a predetermined delay time; and a check valve arranged between the interior of the one end of the hose and the delay means that can be passed through by said ignition flame only in one direction from the end of the hose to the delay means; said check valve exhibiting a valve body displaceable in the longitudinal direction of one end of the hose and said valve body having an end wall resting on an end portion of the hose and radial exhaust openings provided in a proximity of the end wall, said openings being located in the interior of the hose and being sealed by a side wall of the hose; during opening of the check valve, the valve body moving axially into an interspace superjacent the delay means, while a rearward end of the body remains within the hose and the end wall abuts against a charge in contact with the delay means; said charge being capable of suddenly producing such a large quantity of gas upon ignition that the check valve is reclosed by pushing the valve body back into the hose.

* * * * *